US006615750B2

(12) United States Patent
Durant et al.

(10) Patent No.: US 6,615,750 B2
(45) Date of Patent: Sep. 9, 2003

(54) SORBENT CONDITIONING AND DIRECT FEED APPARATUS FOR A STEAM GENERATOR AND A METHOD FOR RETROFITTING A STEAM GENERATOR WITH SAME

(75) Inventors: James F. Durant, Windsor, CT (US); John E. Ferguson, New Hartford, CT (US); Glen D. Jukkola, Glastonbury, CT (US); Reed S C. Rogers, Avon, CT (US)

(73) Assignee: Alstom (Switzerland) Ltd, Baden (CH)

( * ) Notice: Subject to any disclaimer, the term of this patent is extended or adjusted under 35 U.S.C. 154(b) by 0 days.

(21) Appl. No.: 10/073,615

(22) Filed: Feb. 11, 2002

(65) Prior Publication Data

US 2003/0150365 A1 Aug. 14, 2003

(51) Int. Cl.[7] ..... F23K 3/00; F23B 7/00

(52) U.S. Cl. ..... 110/233; 110/101 R; 110/101 CF; 110/101 C

(58) Field of Search ..... 110/245, 347, 110/165 R, 344, 345, 218, 101 CF, 101 C, 101 R, 233

(56) References Cited

U.S. PATENT DOCUMENTS 4,084,545 A * 4/1978 Nack et al. ..... 122/4 D
4,253,409 A * 3/1981 Wormser ..... 110/347
4,262,610 A * 4/1981 Hein et al. ..... 110/342
4,329,324 A * 5/1982 Jones ..... 423/244
5,347,953 A * 9/1994 Abdulally ..... 122/4 D
5,474,034 A * 12/1995 Gounder ..... 122/4 D
5,496,465 A * 3/1996 Fraas ..... 208/400
5,560,550 A * 10/1996 Krawczyk ..... 241/19
5,567,919 A * 10/1996 Cote ..... 177/50

* cited by examiner

*Primary Examiner*—Ira S. Lazarus
*Assistant Examiner*—K. B. Rinehart
(74) *Attorney, Agent, or Firm*—Russell W. Warnock

(57) ABSTRACT

A sorbent conditioning and direct feed apparatus is provided for direct feeding of a conditioned solid sorbent to a combustor 12. The sorbent conditioning and direct feed apparatus includes raw solid sorbent storages means 102, particle size reducing means 112 for reducing the particle size of solid sorbent supplied thereto from a relatively larger coarse particle size to a relatively smaller fine particle size, metering means 108 for metering the supply of raw solid sorbent from the raw solid sorbent storage means to the particle size reducing means 112, and transport means 118 for transporting solid sorbent which has been conditioned by the particle size reducing means 112 to the combustor 12, whereby conditioned solid sorbent is fed to the combustor 12 without any intermediate storage of the solid sorbent between the raw solid sorbent storage means 102 and the transport means 118.

7 Claims, 7 Drawing Sheets

SORBENT CONDITIONING AND DIRECT FEED APPARATUS FOR A STEAM GENERATOR AND A METHOD FOR RETROFITTING A STEAM GENERATOR WITH SAME

BACKGROUND OF THE INVENTION

The present invention relates to a sorbent conditioning and direct feed apparatus which is suitable for use in association with a fossil fuel-fired steam generator including, in particular, a circulating fluidized bed steam generator in a new utility unit application or a retrofit application in an existing utility unit.

Limestone is a natural mineral principally comprised of calcium carbonate, CaCO3, and limestone is used as a desulfurizing or scrubbing medium in fluidized bed combustion units. In these units, combustion materials such as coal and the like are fluidized and combusted in a combustion vessel by contact with upflowing high temperature gasses. Limestone can be mixed with the combustion materials prior to feeding of the combined fuel-sorbent mixture into the unit and the desulfurization process takes place during combustion.

Since the scrubbing or desulfurization process is a chemical reaction, the proper stoichiometric ratio of limestone containing calcium carbonate to flue gas will produce the most efficient reaction. In order for the desulfurization reaction to proceed efficiently and with minimal waste, the limestone must be conditioned such as by grinding to produce a defined particle size prior to use and it is particularly important in the fluidized bed combustion process to control limestone particle size distribution so as to thereby ensure an efficient desulfurization process. If the particles are too large, the desulfurization process will not be efficient because there is insufficient limestone particle surface area to react with the flue gas. On the other hand, if the particles are too small, the limestone will be carried out of the vessel with the flue gas before it can react to remove the sulfur.

Conventional limestone preparation systems often include a drying system having a cyclone or baghouse and typically comprise as well storage hoppers, conveyors, crushing and grinding machines and, in some configurations, vibrating screens. Such conventional systems effect particle size reduction of the limestone in discrete steps including, for example, multiple passes of the limestone particles through size reduction units which is typically performed to progressively reduce the particle size from a relatively larger or coarse particle size to a relatively smaller or fine particle size suitable for introduction into the combustion vessel. Thus, it can be appreciated that such conventional limestone preparation systems generally have a complexity which contributes significantly to their cost and the number of processing operations and transport paths between the various components adds to the operational complexity and maintenance costs of such systems.

Conventional limestone storage and feed systems also typically require separate preparation and storage facilities for the raw sorbent and these facilities add to the capital cost of the utility unit. Also, such facilities may be sited several hundred meters from the combustor of the utility unit, thus adding to the overall space requirements of the utility unit.

SUMMARY OF THE INVENTION

To thus summarize, a need has been evidenced in the prior art for a sorbent conditioning and direct feed apparatus that would be particularly suited for use in effecting the pulverization of sorbent material such as, for example, limestone, and the feed thereof directly to a steam generator including, in particular, a circulating fluidized bed steam generator.

It is, therefore, an object of the present invention to provide a new and improved sorbent conditioning and direct feed apparatus that is particularly suited for use in effecting the pulverization of sorbent material such as, for example, limestone, and the feed thereof directly to a steam generator including, in particular, a circulating fluidized bed steam generator.

Yet a further object of the present invention is to provide such an improved sorbent conditioning and direct feed apparatus which is suitable for installation in new steam generator facilities including, in particular, a circulating fluidized bed steam generator facility.

Yet another object of the present invention is to provide such an improved sorbent conditioning and direct feed apparatus which is capable of being retrofitted in connection with existing steam generator facilities including, in particular, a circulating fluidized bed steam generator facility.

In accordance with one aspect of the present invention, these and other objects of the present invention are achieved by an improved sorbent conditioning and direct feed apparatus which is suitable for installation in new steam generator facilities including, in particular, a circulating fluidized bed steam generator facility and which is capable of being retrofitted in connection with existing steam generator facilities including, in particular, a circulating fluidized bed steam generator facility.

In accordance with the present invention, there is thus provided a sorbent conditioning and direct feed apparatus operable to effect the direct feeding of a conditioned solid sorbent to the combustor. The apparatus includes a raw solid sorbent storage means and a particle size reducing means for reducing the particle size of solid sorbent supplied thereto from the raw solid sorbent storage means from a relatively larger coarse particle size to a relatively smaller fine particle.

Also, the apparatus includes transport for transporting solid sorbent which has been conditioned by the particle size reducing means to the combustor in a manner in which, on average, at least ninety percent (90%) of the conditioned solid sorbent are delivered from the particle size reducing means to the combustor in less than thirty (30) minutes) following their size reduction, whereby conditioned solid sorbent is fed to the combustor with substantially no intermediate storage of the solid sorbent between the raw solid sorbent storage means and the transport means.

According to one aspect of the preferred embodiment of the present invention, the combustor is a fluidized bed combustor. According to another aspect of the preferred embodiment of the present invention, the transport means is a fuel feed transport means operable to transport as well conditioned solid fossil fuel to the fluidized bed combustor, whereby the conditioned solid sorbent and the conditioned solid fossil fuel are fed as a mixture to the fluidized bed combustor. Additionally, the sorbent conditioning and direct feed apparatus preferably comprises control means operatively connected to the raw solid sorbent storage means, the particle size reducing means, and the transport means for controlling the feed of conditioned solid sorbent to the fluidized bed combustor in accordance with a predetermined sorbent feed regime.

According to yet another aspect of the preferred embodiment of the present invention, the sorbent conditioning and direct feed apparatus further comprises means for sensing an operating condition of the fluidized bed combustor operatively connected to the control means, the control means being operable to control the feed of conditioned solid sorbent to the fluidized bed combustor in response to a sensed operating condition of the fluidized bed combustor. The means for sensing an operating condition of the fluidized bed combustor can be operable to sense a sulfur concentration in the fluidized bed combustor.

According to a further additional aspect of the preferred embodiment of the present invention, the particle size reducing means is a roller mill. Alternatively, the particle size reducing means is a roll crusher. Also, according to a supplemental aspect of the preferred embodiment of the present invention, the conditioned solid fossil fuel is subjected to a separate particle size reduction operation prior to the supply thereof to the transport means and the fluidized bed combustor is supplied by the transport means with a mixture of conditioned solid fossil fuel and conditioned solid sorbent. The transport means may alternatively be configured as a pneumatic transport assembly operable to pneumatically transport conditioned sorbent to the steam generator from any air swept mill or crusher or as a mechanical transport assembly.

BRIEF DESCRIPTION

DETAILED DESCRIPTION OF THE PREFERRED EMBODIMENT

Figure 1:
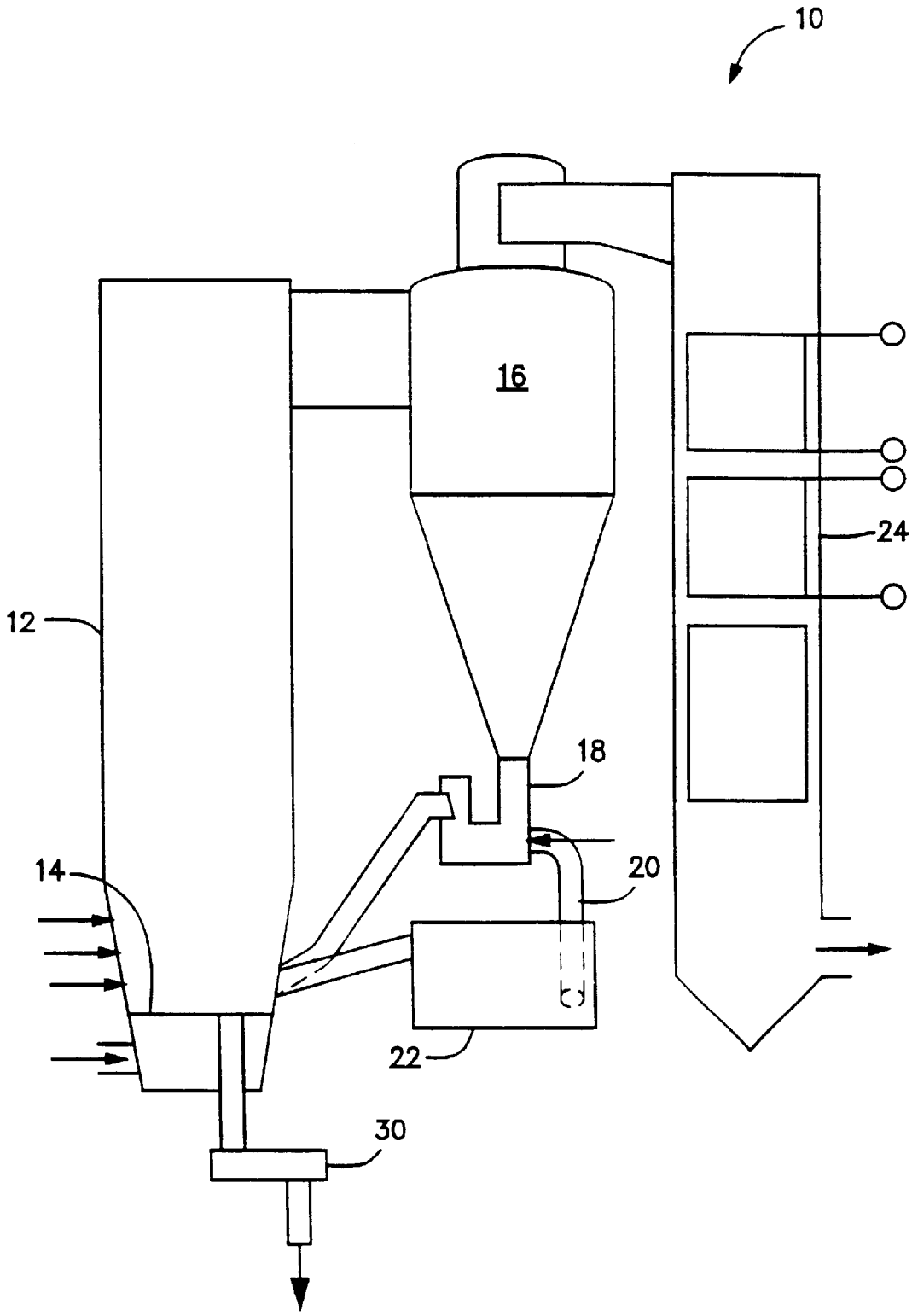
FIG. 1 is a side elevational view of a circulating fluidized bed steam generator of the type with which the sorbent conditioning and direct feed apparatus of the present invention can be operatively associated to feed conditioned sorbent thereto.

Referring now to FIG. 1 there is shown a typical circulating fluidized bed steam generator to which the sorbent conditioning and direct feed apparatus of the present invention has particular application. Crushed fuel and sorbent are normally fed to the lower portion of a combustor 12. Typically the fuel and sorbent material are fed to a chute (not shown) that is disposed at approximately a 60 degree angle from horizontal. Thus, the fuel and sorbent pass along the chute and into the combustor 12. Primary air is supplied to the bottom of the combustor through an air distributor 14 with secondary air fed through one or more air ports at various elevations in the lower part of the combustor. Combustion takes place throughout the combustor 12 which is filled with bed material. Flue gas and entrained solids leave the combustor 12 and enter one or more cyclones 16 where the solids are separated and fall to a seal pot 18. From the seal pot 18, the solids are recycled to the combustor 12. Optionally, some solids may be diverted through an ash control valve 20 to a fluidized bed heat exchanger 22. Flue gas leaving the cyclone 16 passes to a convective pass 24 and then to an air heater, a bag house or an electrostatic precipitator, and fan (not shown). The solids in the combustor 12 are periodically allowed to pass out of the combustor 12 by draining these hot solids through an ash cooler 30 or, in lieu of the ash cooler 30, an ash screw may be provided to periodically remove the hot solids.

Figure 2:
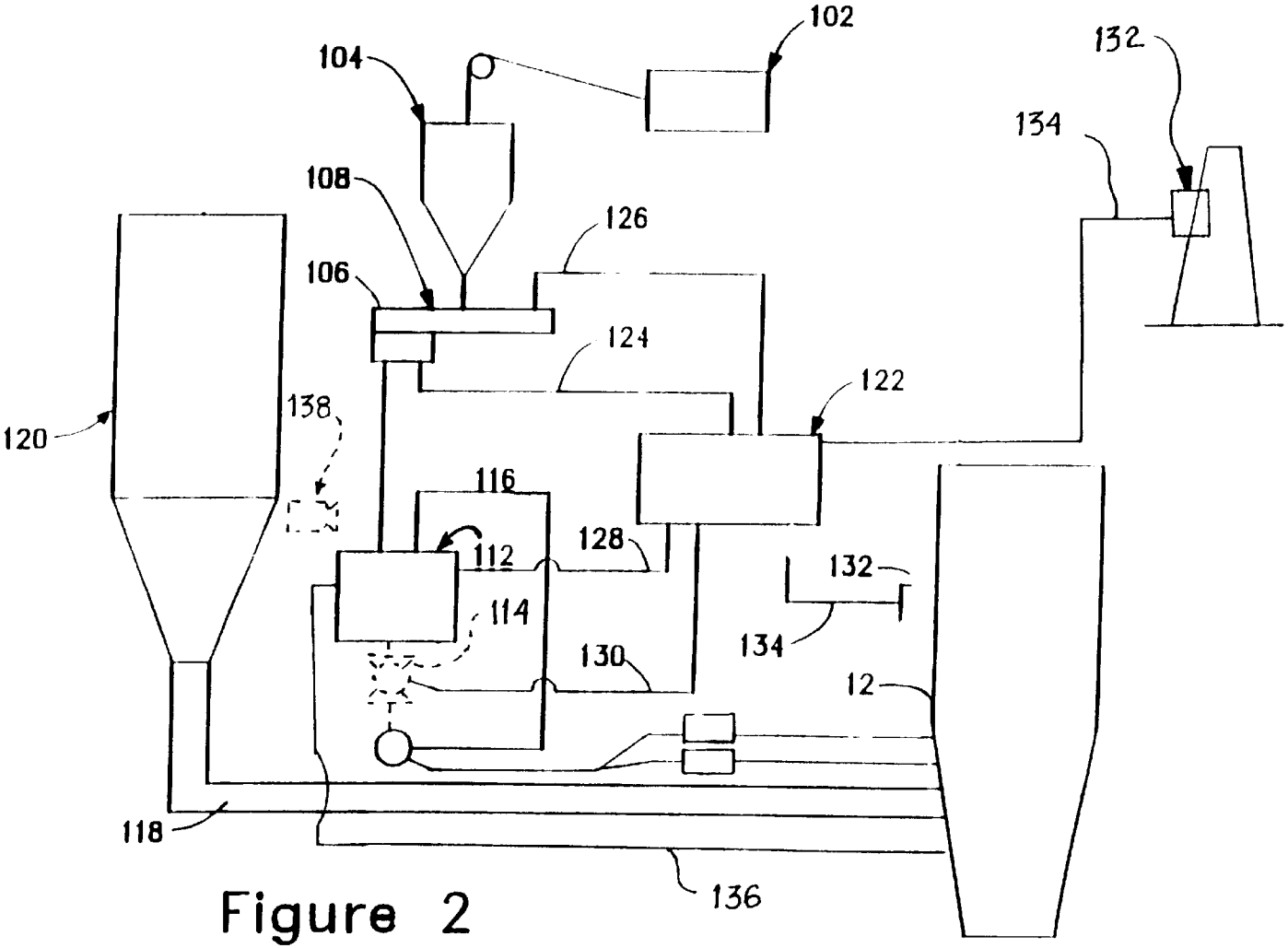
FIG. 2 is a side schematic view of one embodiment of the sorbent conditioning and direct feed apparatus of the present invention.

One preferred embodiment of the sorbent conditioning and direct feed apparatus of the present invention is illustrated in the schematic arrangement of FIG. 2 in which limestone, which has not yet been subjected to a particle size reduction treatment, is conditioned into a final particle size distribution in which the conditioned limestone can be fed into a steam generator. The steam generator can be, for example, a circulating fluidized bed steam generator such as the one illustrated in FIG. 1 having a combustor 12. Limestone is supplied from a conventional limestone storage facility 102 to a feed hopper 104. Limestone is hen fed by the feed hopper 104 onto a weigh scale belt 106 which is part of a gravimetric feeder device 108 and is moved thereby to fall through a chute 110 into the selected particle size reducing apparatus 112 which may be configured as, for example, a roller mill or a roll crusher. The particle size reducing apparatus 112 is driven by a conventional prime mover (not shown) which is controllable as will be presently described.

A conventional rotary valve 114 controls the supply of the conditioned limestone having a size below a predetermined size which has exited the particle size reducing apparatus 112 via an outlet 116. The rotary valve 114 controls the supply of conditioned limestone to a pneumatic transport assembly 118 which transports the conditioned limestone to feed inlets of the combustor 12. One configuration of the particle size reducing apparatus 112 which can advantageously make use of a transport arrangement of the type including the rotary valve 114, the outlet 116, and the pneumatic transport assembly 118 could be, for example, a roll crusher. Alternatively, in accordance with a variation of the sorbent conditioning and direct feed apparatus of the present invention, an air swept arrangement having conventional features may be deployed in lieu of the rotary valve 114, the outlet 116, and the pneumatic transport assembly 118 to effect the transport of the conditioned sorbent from the particle size reducing apparatus 112 to the combustor 12. One configuration of the particle size reducing apparatus 112 which can advantageously make use of a transport arrangement of the type including an air swept arrangement could be, for example, a roller mill. This air swept arrangement could include, for example, a suitable conventional heated air take-off duct assembly to convey heated air from the combustor 12 to the particle size reducing apparatus 112 and a suitable conventional return duct assembly to convey the heated air, with the conditioned sorbent entrained therewith, from the particle size reducing apparatus 112 to the combustor 12.

Conditioned solid fuel such as, for example, crushed coal, is supplied separately to the combustor 12 from a solid fuel feed supply 120.

A limestone feed system control unit 122 controls the limestone feed operation through the various assemblies just noted to ultimately feed conditioned limestone to the circulating fluidized bed steam generator. The limestone feed system control unit 122 is connected via a connector 124 to the drive motor which drives the belt of the weight scale belt 106 of the gravimetric feeder device 108 and is connected via a connector 126 to the weight assessment sub-assembly of the gravimetric feeder device 108 for receiving from the connectors 124 and 126 signals relating to the output rate and the quantity (i.e., volume by weight) of the limestone being fed by the gravimetric feeder device 108 to the particle size reducing apparatus 112.

A connector 128 connects the limestone feed system control unit 122 to the drive motor of the particle size reducing apparatus 112 and a connector 130 connects the limestone feed system control unit to an optional rotary valve 114. The limestone feed system control unit can, thus, in connection with selected particle size reducing scenarios, control the operation of the particle size reducing apparatus 112 and the supply rate of the rotary valve 114. In accordance, for example, with one typical control regime, as the limestone feed system control unit 122 controls the speed of the particle size reducing apparatus 112 to thereby increase the output of the conditioned limestone, the rotary valve 114 is controlled to increase the supply rate of conditioned limestone to the fuel feed transporter 118.

A conventional sulfur level sensing device 132 is located relative to the combustor 12 for continuously sensing or monitoring the sulfur level in the flue gas, whereby the sulfur level sensing device 132 may be located, for example, on the flue gas outlet stack. The sulfur level sensing device 132 is connected via a connector 134 to the limestone feed system control unit 122 for providing signals thereto concerning the sensed sulfur level in the flue gas. A moisture control assembly 136 is provided to control the moisture content of the conditioned limestone to a desired level. The moisture control assembly 136 preferably selectively effects drying of the raw limestone upstream of the particle size reducing apparatus 112 by, for example, drying the raw limestone stored in the limestone storage facility 102 to a predetermined feed moisture of, say, 1 to 10 such that the conditioned limestone fed to the combustor 12 has the desired moisture content. The moisture control assembly 136 can be configured with a conventional externally powered or fueled drying device such as, for example, a gas-fired drying device which applies heated air to the raw limestone to effect drying thereof. Preferably, however, the moisture control assembly 136 is configured to use process heat generated in connection with the operation of the steam generator and, to this end, the moisture control assembly 136 may include an optional externally powered heater 138 or a duct and damper sub-assembly which communicates the particle size reducing apparatus 112 with the combustor 12 such that process heat from the combustor 12 can be selectively applied to the limestone in the particle size reducing apparatus 112 to effect the drying thereof. The sorbent conditioning and direct feed apparatus of the present invention advantageously permits a process heat arrangement of this type to be used in a cost effective manner in that the sorbent conditioning and direct feed apparatus can be located sufficiently proximate to the combustor 12—that is, typically less than 50 meters therefrom—to permit process heat to be transferred to the particle size reducing apparatus 112 in a cost favorable manner. In contrast, in a conventional limestone storage and conditioning arrangement, the limestone storage facility which performs the limestone storage function of the limestone storage facility 102 is typically located several hundred meters from the combustor and it is thus not cost justifiable to deliver process heat from the combustor over the several hundred meter distance.

The operation of the particle size reducing apparatus 112 to effect a size reduction of the limestone is controlled in response to certain signals received by the limestone feed system control unit 122 from the various components connected thereto. Thus, for example, in accordance with one exemplary limestone feed control regime, the limestone feed system control unit 122 receives signals from the sulfur level sensing device 132 concerning the sensed sulfur level in the flue gas and the limestone feed system control unit 122 evaluates these signals to determine the need for feeding limestone to the combustor. When the limestone feed system control unit 122 determines a need to supply the prepared limestone particles to the combustor 12, the limestone feed system control unit 122 controls the feed hopper 104 to feed raw untrammeled limestone onto the gravimetric feed device 108. The operation of the gravimetric feed device 108 is also controlled by the limestone feed system control unit 122 to effect the supply to of a predetermined volume (by weight) of raw untrammeled limestone to the particle size reducing apparatus 112. The particle size reducing apparatus 112 then performs a size reduction operation on the limestone supplied thereto and the thus conditioned limestone particles exit the particle size reducing apparatus 112 into the pneumatic transport assembly 118. If the particle size reducing 112 is configured, for example, as a conventional roller mill, the optional rotary valve 114 is omitted and the conditioned limestone particles will exit the roller mill directly to the pneumatic transport assembly 118 as a function of the classification operation of the roller mill. The thus supplied limestone particles are then transported to the combustor 12. In connection with a sensing operation by the sulfur level sensing device 132 which indicates that the desired sulfur level in the combustor 12 has been achieved, the limestone feed system control unit 122 controls the system to reduce or increase the supply of prepared limestone.

Figure 3:
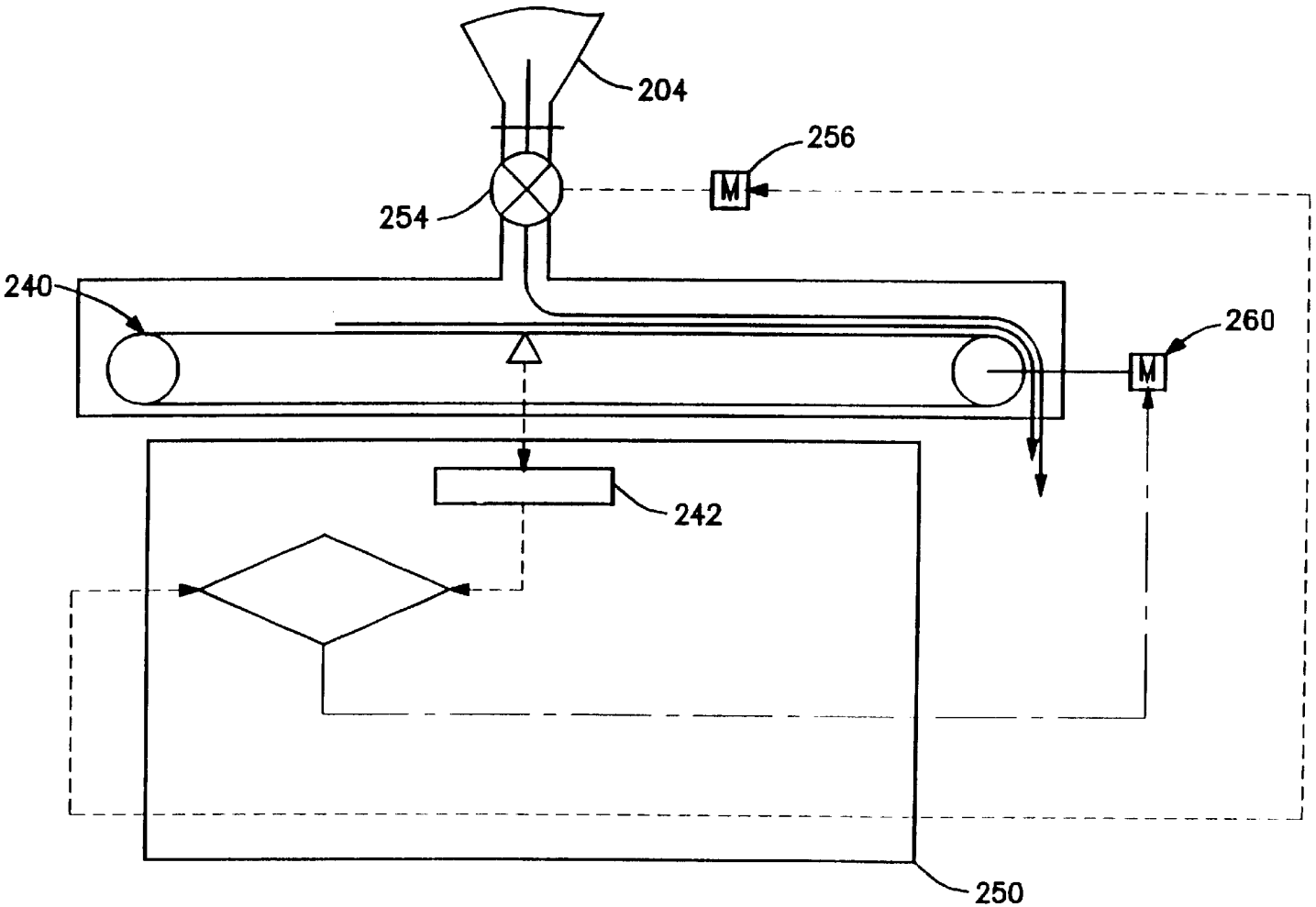
FIG. 3 is an enlarged side view in partial section of the gravimetric feed device of the one embodiment of the sorbent conditioning and direct feed apparatus shown in FIG. 2.

As shown in FIG. 3, the gravimetric feed device 108 is preferably configured as a single belt feeder 240 for sorbent. Disposed at spaced intervals along the belt feeder 240 is a first belt scale 242. Disposed upstream respectively from the belt scale 242 is the feed hopper 204 which feeds sorbent to the belt feeder 240. A programmable logic controller 250 receives inputs from the first belt scale 242. The sorbent will be dumped off the belt feeder 240 at the right (as shown in the drawing) hand end of the belt feeder 240. A programmable logic controller 250 is optionally provided to which is supplied an input (the weight) from the belt scale 242. The supply of sorbent to the belt feeder 240 from the feed hopper 204 is controlled by a rotary valve 254.

The rotary valve 254 is controlled by a motor 256 which is in turn controlled by the programmable logic controller 250. The control of the motor 256 driving the rotary valve 254 determines the actual amount of sorbent delivered to the belt feeder 240. The programmable logic controller 250 compares the actual feed rate to the intended or desired gravimetric feed rate. It will be understood that a motor 260 is provided to drive the continuous belt feeder 240 and that this motor 260 is driven at a speed and/or periods of time corresponding to the desired rate of delivery of sorbent to the limestone conditioning operation and from there, to the combustion process in the circulating fluidized bed steam generator. More specifically, the belt scale 242 sends a signal to the motor 260 and thus controls the motor 260. The signal from the programmable logic controller 250 to the motor

260 is a function of the weight of the sorbent added to the belt feeder 240 per unit of time. It will also be seen that the relative rate of sorbent feed is controlled by the motor 256 controlling the valve 254 and that this control is achieved by the programmable logic controller 250.

In some forms of the invention, the programmable logic controller 250 may be a dedicated programmable logic controller. The programmable logic controller 250 is a common commercial commodity and typical dedicated programmable logic controllers. In other forms of the invention the programmable logic controller 250 may be part of the distributed control system of the plant in which the fluidized bed steam generator is located.

Figure 4:
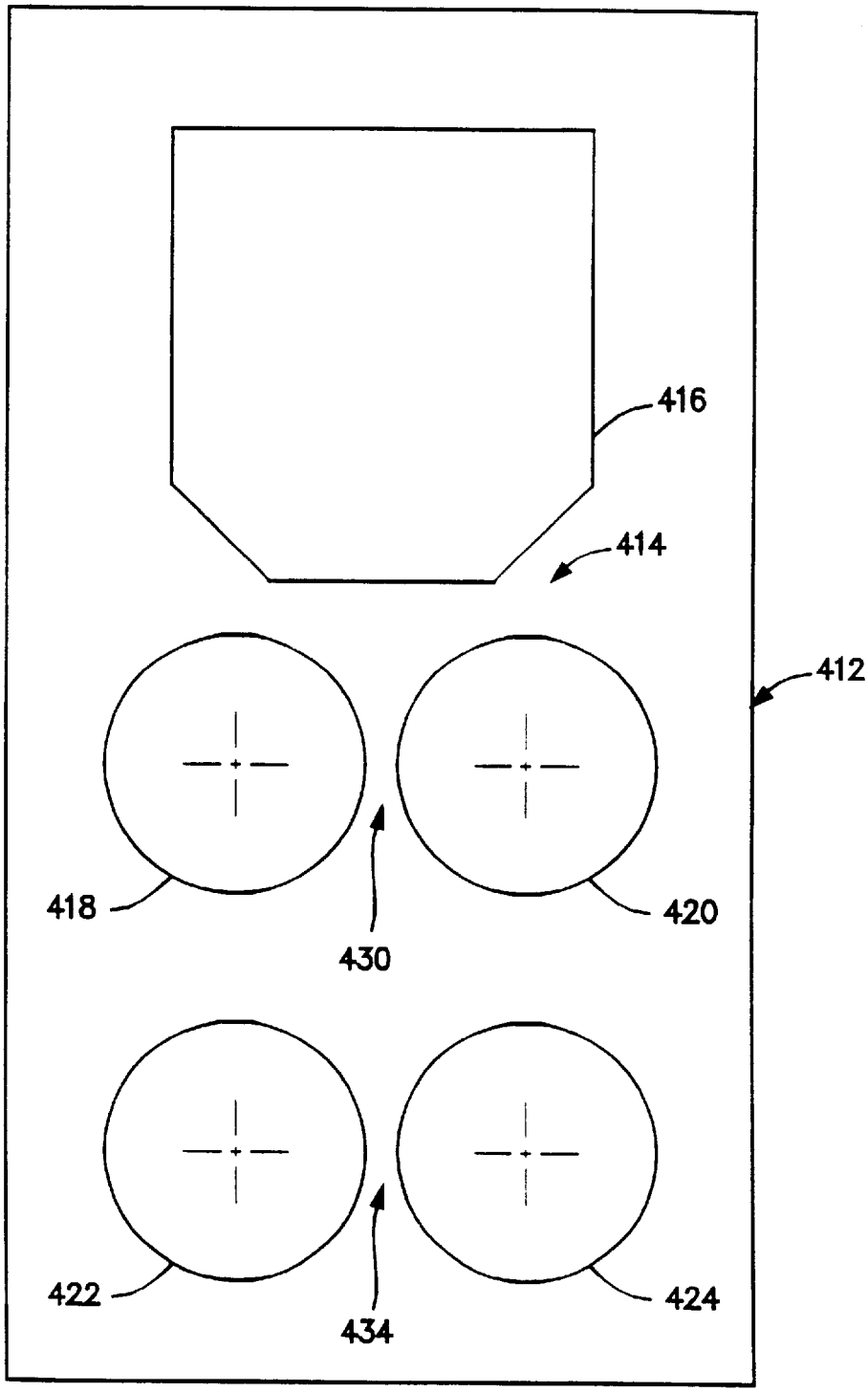
FIG. 4 is an enlarged side elevational view of a roll crusher for use with the one embodiment of the sorbent conditioning and direct feed apparatus shown in FIG. 1.

Thus, the one embodiment of the sorbent conditioning and direct feed apparatus illustrated in FIG. 2 is operable to effect the direct feeding of a conditioned solid sorbent to the combustor 12. The apparatus includes a raw solid sorbent storage means in the form of the limestone storage facility 102 and a particle size reducing means for reducing the particle size of solid sorbent supplied thereto from the raw solid sorbent storage means from a relatively larger coarse particle size to a relatively smaller fine particle size in the form of the particle size reducing apparatus 112. Also, the apparatus includes transport means in the form of the fuel feed transporter 118 for transporting solid sorbent which has been conditioned by the particle size reducing means to the combustor in a manner in which, on average, at least ninety percent (90%) of the conditioned solid sorbent are delivered from the particle size reducing means to the combustor in less than thirty (30) minutes) following their size reduction, whereby conditioned solid sorbent is fed to the combustor with substantially no intermediate storage of the solid sorbent between the raw solid sorbent storage means and the transport means. Thus, it is contemplated that the present invention encompasses (a) those material feed apparatus configured to deliver the entirety of the conditioned solid sorbent directly to the combustor without any diversion enroute of a portion of the conditioned solid sorbent; and (b) those material feed apparatus configured to permit an insubstantial enroute diversion of the conditioned solid sorbent during its travel between the particle side reducing means and the combustor. An example of an insubstantial enroute diversion of the conditioned solid sorbent is the removal of a sample size portion of the conditioned solid sorbent to permit testing or quality control measures to be performed on the removed sample size portion. Another example of an insubstantial enroute diversion of the conditioned solid sorbent is the creation of an operational reserve of the conditioned solid sorbent designed to accommodate inline feed variations in the mass flow of the conditioned solid sorbent and this volume of this operational reserve is considered to be many orders of magnitude less than the storage volume of conditioned solid sorbent which is typically stored in a dedicated large volume silo or other structure in connection with conventional conditioned solid sorbent preparation and feed arrangements. As shown in FIG. 4 in conjunction with, respectively, FIGS. 5A and 5B, a roll crusher can be provided as the preferred configuration of the particle size reducing apparatus 112 for effecting the size reduction of the limestone particles. As seen in one variation of such a roll crusher embodiment shown in FIG. 5A, this variation of the one embodiment of the sorbent conditioning and direct feed apparatus includes a roll crusher 412 for effecting the particle size reduction of the limestone. The roll crusher 412, as seen in more detail in FIG. 4, comprises a feed area 414 for feeding raw untrammeled limestone from a raw material feed arrangement 416, a first pair of grinding rolls 418, 420 and a second pair of grinding rolls 422, 424. The first pair 418, 420 of grinding rolls and the second pair 422, 424 of grinding rolls are each driven by independent drive means (not shown) such as electric motors. The raw untrammeled limestone is fed from the feed area 414 by gravity. The first pair of grinding rolls 418, 420 comprises opposing rotating rolls 418, 420 which each rotate about a horizontal axis in a respective direction of rotation opposite to that of the other grinding roll. The rolls 418, 240 form therebetween a first nip 430, which is adjustably or fixedly set in dependence upon the raw untrammeled limestone particle size.

The second pair of grinding rolls 422, 424 comprises opposing rotating rolls which each rotate about a horizontal axis in a respective direction of rotation opposite to that of the other grinding roll. The rolls 422, 424 are separated by a second nip 434, which is based upon the final product particle size distribution desired. A preferred particle size distribution is comprised of particles smaller than 2 mm and, generally, smaller than 1 mm, and having a mean size of about 300 microns. Preferably, the particle size distribution is produced with the nip 434 between the second set of rolls 422, 424 in the range of about 2 to 3 mm.

Each of the grinding rolls of the first pair 418, 420 and the second pair 422, 424 of grinding rolls rotate at different velocities relative to its opposed paired grinding roll to produce a shear in the particles as they pass into and through the nip 430 and the nip 434. Raw untrammeled limestone is fed by the raw material feed arrangement 416 into the feed area 414. The limestone then falls into the nip area 430 of the first pair of rolls 418, 420. Grinding of the limestone particles occurs in the nip 430 and, as the limestone travels therethrough, the compression and shear imparted by the rolls 418, 420, on the limestone causes the particles to work against each other thereby breaking down or fracturing the crystalline structure. The particle size distribution of the product is controlled in that, the larger the nip, the less the work that is done on the limestone particles, while, the smaller the nip, the greater the work that is done on the limestone particles. As the limestone passes beyond the first nip 430, it falls into the second nip 434 at which it is subjected to further size reduction by the second pair of grinding rolls 422, 424. The one variation of the roll crusher embodiment of the sorbent conditioning and direct feed apparatus shown in FIGS. 4 and 5A also includes, in lieu of the pneumatic transport assembly 118 described with respect to FIG. 2, a fuel feed transporter 436 for feeding the conditioned limestone to the circulating fluidized bed steam generator along with raw or conditioned solid fuel such as, for example, raw untrammeled coal or crushed coal, which is supplied from a solid fuel feed supply. The fuel feed transporter 436 may be configured, for example, as a conventional mechanical transporter in the form of, for example, an endless belt conveyor. The conditioned limestone particles exiting the second pair of grinding rolls 422, 424, having thus been reduced in size to achieve the desired particle size distribution, are then released into the pneumatic transport stream of the pneumatic transport assembly 436 in a metered manner by means, for example, of a conventional rotary valve arrangement, and supplied thereby along with the solid fuel into the circulating fluidized bed steam generator.

Figure 5A:
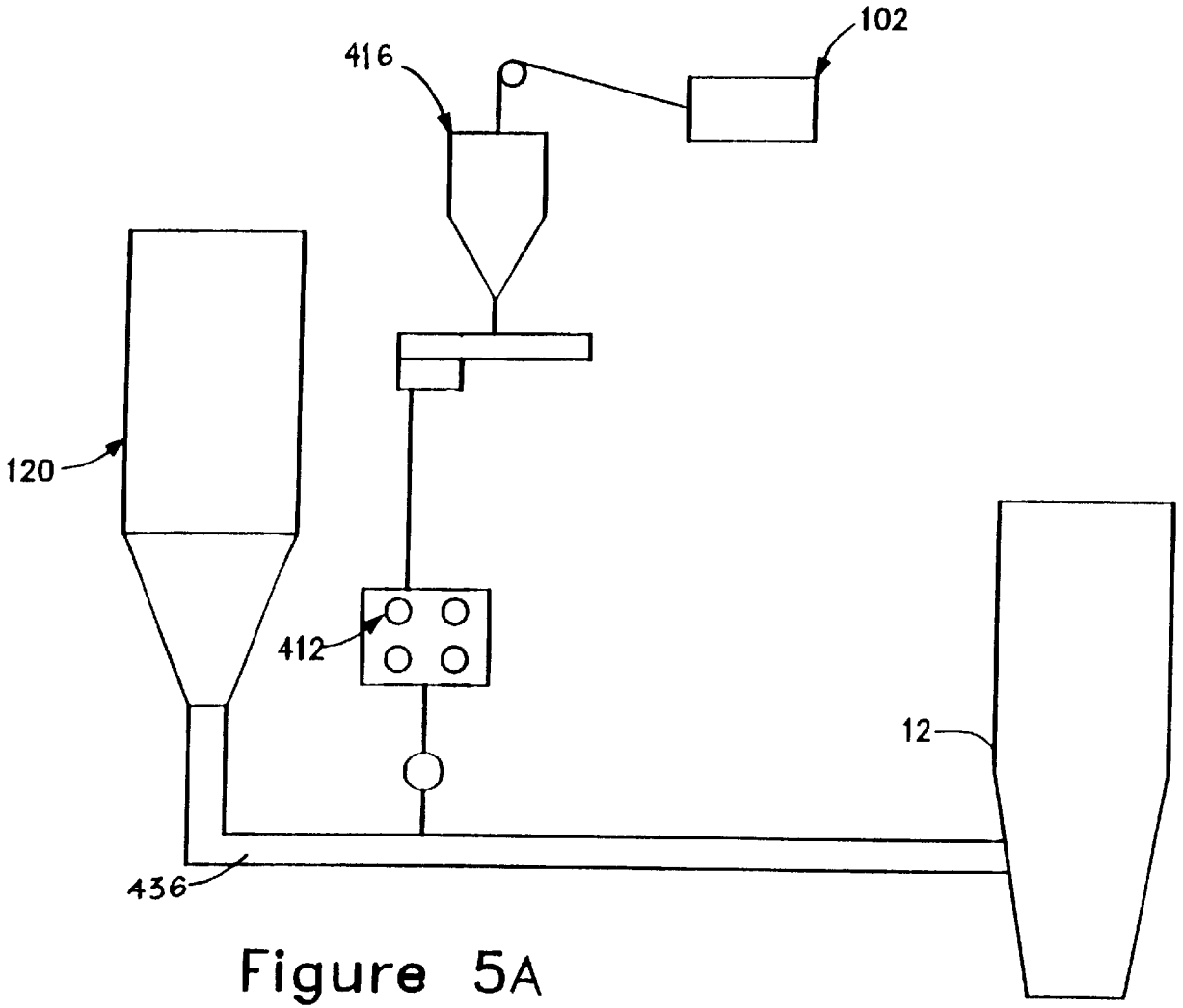
FIG. 5A is a side schematic view of one variation of an embodiment of the sorbent conditioning and direct feed apparatus of the present invention having the roll crusher shown in FIG. 4.
Figure 5B:
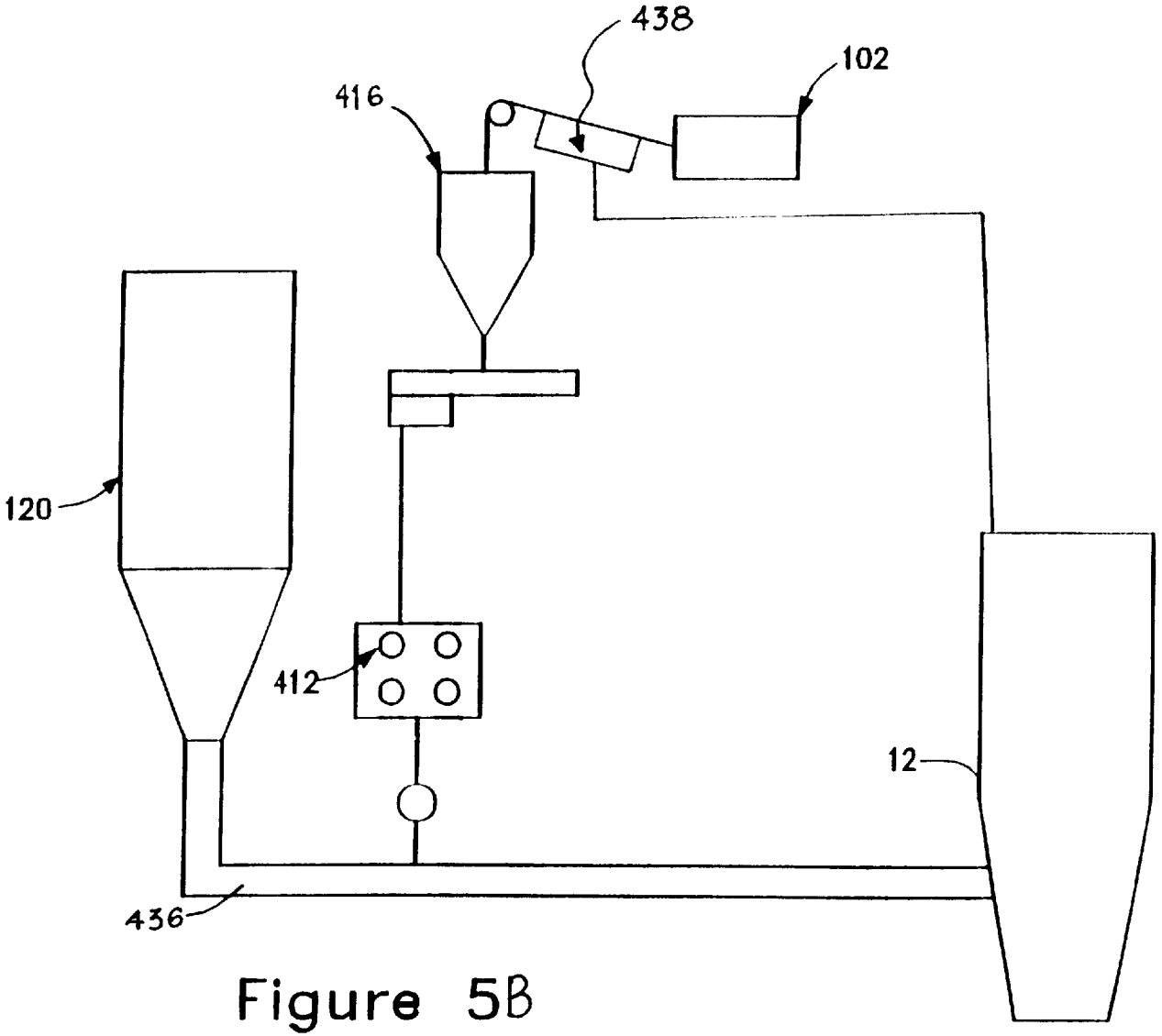
FIG. 5B is a side schematic view of another variation of an embodiment of the sorbent conditioning and direct feed apparatus of the present invention having the roll crusher shown in FIG. 4.

As seen in another variation of such a roll crusher embodiment shown in FIG. 5B, this variation of the one embodiment of the sorbent conditioning and direct feed apparatus includes all of the features of the one roll crusher embodiment variation shown in FIG. 5A with the addition, in this other variation, of a drying arrangement 438 for effecting at least some reduction in the moisture content of the raw limestone prior to its feed into the roll crusher. The drying arrangement 438 may be configured, for example, as a conventional tempered air drying arrangement which diverts a portion of the air heated in the circulating fluidized bed steam generator and, by means of a conventional rotary dryer, passes the heated air into contact with the raw limestone with the now cooler heated air being returned via a return loop to the steam generator.

Figure 6:
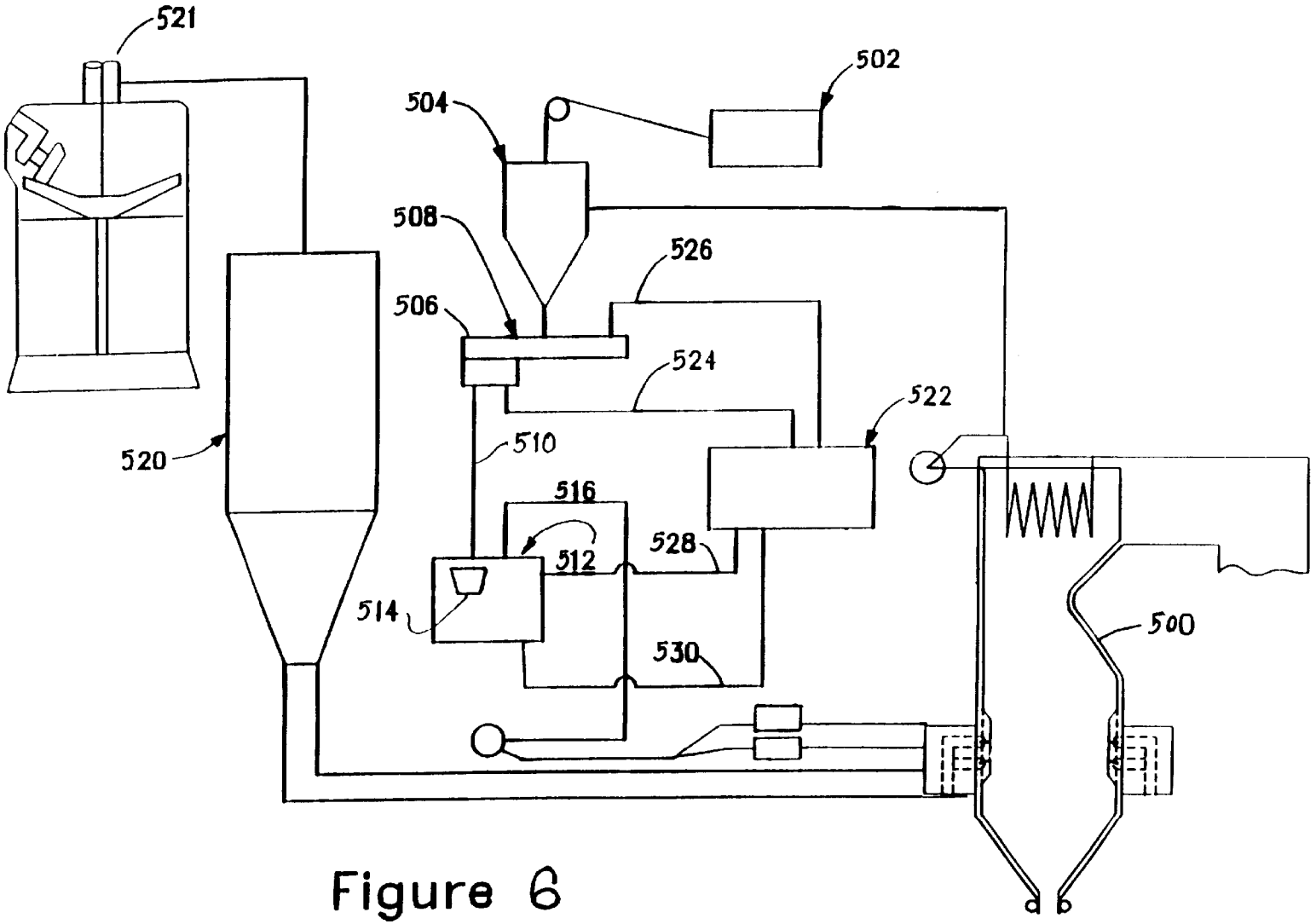
FIG. 6 is a side schematic view of a further embodiment of the sorbent conditioning and direct feed apparatus of the present invention for use with a direct fired pulverized coal combustor.

A further preferred embodiment of the sorbent conditioning and direct feed apparatus of the present invention is illustrated in the schematic arrangement of FIG. 6 in which limestone, which has not yet been subjected to a particle size reduction treatment, is conditioned into a final particle size distribution in which the conditioned limestone can be fed into a direct fired steam generator such as a pulverized coal combustor having comer mounted or wall mounted burners for directly injecting pulverized coal and conditioned limestone into the combustor. The steam generator shown in FIG. 6 is exemplarily illustrated as a conventional pulverized coal direct fired boiler 500.

Limestone is supplied from a conventional limestone storage facility 502 to a feed hopper 504. Limestone is then fed by the feed hopper 504 onto a weigh scale belt 506 which is part of a gravimetric feeder device 508 and is moved thereby to fall through a chute 510 into the selected limestone size conditioning apparatus such as, for example, a roller mill 512. The roller mill 512 is driven by a conventional prime mover (not shown) which is controllable as will be presently described.

The roller mill 512 may optionally include a dynamic classifier or a static classifier for classifying the limestone particles conditioned by the roller mill. Merely for the purpose of illustrating such an option, the sorbent conditioning and direct feed apparatus shown in FIG. 6 is provided with a dynamic classifier 514, whose rate of rotation is controllable as will be presently described, which classifies the limestone in the roller mill 512 such that a portion of the conditioned limestone having a size below a predetermined size are permitted to exit the roller mill 512 via an outlet 516 while another portion of the limestone having a size above the predetermined size are returned to the grinding area of the roller mill 512 for further size reduction. The outlet 516 communicates with a conventional pneumatic transport assembly 518 operable to pneumatically transport conditioned limestone from the roller mill 512 to the plurality of burners at which the conditioned limestone is mixed with pulverized coal during direct firing thereof into the pulverized coal direct fired boiler 500. The conditioned limestone travels from the outlet 516 via the pneumatic transport assembly 518 to the pulverized coal direct fired boiler 500 at which it is combined with the pulverized solid fuel such as, for example, pulverized coal, which is supplied from a solid fuel feed supply 520. The pulverized coal is itself supplied to the solid fuel feed supply 520 in a separate solid fossil fuel preparation process which may include, for example, size reduction of raw untrammeled coal in a conventional pulverizer 521. The conventional pulverizer 521 uses some combination of impact, attrition and crushing to reduce a solid fuel to a particular particle size. Several types of pulverizer mills can be employed for the pulverization of the solid fuel, which may be, for example, coal, to a particulate size appropriate for firing in a furnace. These can comprise, for example, ball-tube mills, impact mills, attrition mills, ball race mills, and ring roll or bowl mills. Most typically, however, bowl mills are employed for the pulverization of the solid fuel to allow for direct firing of the pulverized fuel entrained in an air stream.

A limestone feed system control unit 522 controls the limestone feed operation through the various assemblies just noted to ultimately feed conditioned limestone to the pulverized coal direct fired boiler 500. The limestone feed system control unit is connected via a connector 524 to the drive motor which drives the belt of the weight scale belt 506 of the gravimetric feeder device 508 and is connected via a connector 526 to the weight assessment sub-assembly of the gravimetric feeder device 508 for receiving from the connectors 524 and 526 signals relating to the output rate and the quantity (i.e., volume by weight) of the limestone being fed by the gravimetric feeder device 508 to the roller mill 512.

A connector 528 connects the limestone feed system control unit 522 to the grinding bowl drive motor of the roller mill 512 and a connector 530 connects the limestone feed system control unit to the dynamic classifier 514. The limestone feed system control unit thus controls the speed of the roller mill 512 and the speed of the dynamic classifier 514. In accordance, for example, with one typical control regime, as the limestone feed system control unit controls the speed of the roller mill 512 to thereby increase the grinding capacity of the limestone, the speed of the dynamic classifier 514 is reduced.

In lieu of the sulfur level sensing performed by the sulfur level sensing device 132 described with respect to the one embodiment of the sorbent conditioning and direct feed apparatus shown in FIG. 2, the further embodiment of the sorbent conditioning and direct feed apparatus shown in FIG. 6 does not perform any real time sulfur sensing but, instead, operates to control the feed of conditioned limestone to the pulverized coal direct fired boiler 500 in accordance with a pre-programmed limestone feed regime. The limestone feed system control 522 is configured to increase, decrease, or maintain the feed rate of the conditioned limestone to the pulverized coal direct fired boiler 500 in accordance with a limestone feed program stored in the limestone feed system control. The stored limestone feed program is configured based upon empirical data concerning suitable limestone feed rates.

The operation of the roller mill 512 for grinding limestone is subjected to certain signals received by the limestone feed system control unit 522 from the various components connected thereto. Thus, for example, in accordance with one exemplary limestone feed control regime, the limestone feed system control unit 122, in accordance with the stored limestone feed program, controls the feed hopper 104 to feed raw untrammeled limestone onto the gravimetric feed device 108 at a predetermined feed rate. The operation of the gravimetric feed device 108 is also controlled by the limestone feed system control unit 122 to effect the supply of a predetermined volume (by weight) of raw untrammeled limestone to the roller mill 512. The roller mill 512 then performs a size reduction operation on the limestone supplied thereto while the limestone feed system control unit 122 controls the operation of the classifier 514 to ensure that the limestone particles exiting the roller mill 512 onto the pneumatic transport assembly 518 conform to the desired particle size distribution. The thus supplied limestone particles are then transported by the pneumatic transport assembly 518 to the pulverized coal direct fired boiler 500. In connection with outputs from the stored limestone feed program, the limestone feed system control unit 522 controls the system to reduce or cease the supply of prepared limestone.

While an embodiment and variations of the present invention have been shown, it will be appreciated that modifications thereof, some of which have been alluded to hereinabove, may still be readily made thereto by those skilled in the art. It is, therefore, intended that the appended claims shall cover the modifications alluded to herein as well as all the other modifications which fall within the true spirit and scope of the present invention.

We claim:

1. A sorbent conditioning and direct feed apparatus for direct feeding of a conditioned solid sorbent to a fluidized bed combustor, comprising:

raw solid sorbent storage means;

particle size reducing means for reducing the particle size of solid sorbent supplied thereto from the raw solid sorbent storage means from a relatively larger coarse particle size to a relatively smaller fine particle size;

transport means for transporting to the combustor solid sorbent which has been conditioned by the particle size reducing means, in a separate particle size reduction operation prior to the supply thereof to the transport means, in a manner in which, on average, at least ninety percent (90%) of the conditioned solid sorbent are delivered from the particle size reducing means to the combustor in less than thirty (30) minutes following their size reduction, whereby conditioned solid sorbent is fed to the combustor with substantially no intermediate storage of the solid sorbent between the raw solid sorbent storage means and the transport means and the transport means is a fuel feed transport means operable to transport as well conditioned solid fossil fuel to the fluidized bed combustor whereby the conditioned solid sorbent and the solid fossil fuel are fed as a mixture to the fluidized bed combustor;

control means operatively connected to the raw solid sorbent storage means, the particle size reducing means, and the transport means for controlling the feed of conditioned solid sorbent to the fluidized bed combustor in accordance with a predetermined sorbent feed regime; and means for sensing a sulfur concentration in the fluidized bed combustor operatively connected to the control means, the control means being operable to control the feed of conditioned solid sorbent to the fluidized bed combustor in response to a sensed sulfur concentration condition of the fluidized bed combustor.

2. A sorbent conditioning and direct feed apparatus according to claim 1 wherein the particle size reducing means is a roller mill.

3. A sorbent conditioning and direct feed apparatus according to claim 1 wherein the particle size reducing means is a roll crusher.

4. A sorbent conditioning and direct feed apparatus according to claim 1 wherein the particle size reducing means is an impact mill.

5. A sorbent conditioning and direct feed apparatus according to claim 1 wherein the particle size reducing means is a rod mill.

6. A sorbent conditioning and direct feed apparatus according to claim 1 wherein the particle size reducing means is a hammer crusher.

7. A sorbent conditioning and direct feed apparatus according to claim 1 wherein the transport means includes a mechanical transport assembly and the conditioned solid sorbent is transported solely by mechanical transport to the fluidized bed combustor.

* * * * *